United States Patent [19]

Fukuhara

[11] Patent Number: 4,625,527

[45] Date of Patent: Dec. 2, 1986

[54] KNITTING PLATE NEEDLE AND ITS MANUFACTURING METHOD

[75] Inventor: Masao Fukuhara, Wakayama, Japan

[73] Assignee: Fukuhara Needle Company, Ltd., Wakayama, Japan

[21] Appl. No.: 850,603

[22] Filed: Apr. 11, 1986

[30] Foreign Application Priority Data

Apr. 12, 1985 [JP] Japan ..... 60-079116

[51] Int. Cl.[4] ..... D04B 35/02

[52] U.S. Cl. ..... 66/123; 66/120

[58] Field of Search ..... 66/123, 121, 120

[56] References Cited

U.S. PATENT DOCUMENTS

| | | | |
|---|---|---|---|
| 3,748,875 | 7/1973 | Slof et al. | 66/123 |
| 3,949,572 | 4/1976 | Kopal et al. | 66/123 |
| 4,036,036 | 7/1977 | Ashmead et al. | 66/123 |
| 4,068,500 | 1/1978 | Kohorn | 66/123 |
| 4,452,053 | 6/1984 | Egbers et al. | 66/123 |
| 4,553,411 | 11/1985 | Schuler et al. | 66/123 |
| 4,562,705 | 1/1986 | Berentzen | 66/121 |

*Primary Examiner*—Ronald Feldbaum

*Attorney, Agent, or Firm*—Bell, Seltzer, Park & Gibson

[57] ABSTRACT

Elongate grooves are provided along both or one side of the shank of a knitting needle. The elongate groove is parallel with the back edge and is positioned between the back and front edges of the shank of the needle. The elongate grooves reduce the weight of the needle without substantially reducing the vertical rigidity of the shank of the needle and function to reduce the transmission of impact shock from the needle butt to the hook. The grooves also provide a passageway extending longitudinally along the needle shank to provide for improved retention and distribution of lubricant along the needle shank.

7 Claims, 6 Drawing Figures

KNITTING PLATE NEEDLE AND ITS MANUFACTURING METHOD

FIELD OF THE INVENTION

This invention relates generally to knitting needles having enhanced shock absorbing characteristics, and more particularly to latch needles for circular knitting machines and to the manufacturing method wherein the needles are stamped from a thin steel plate and are provided with one or more elongate grooves extending longitudinally along at least one side of the elongate shank to provide the improved shock absorbing characteristics and to provide a passageway extending longitudinally along the needle shank for improving the retention and distribution of lubricant along the needle shank.

BACKGROUND OF THE INVENTION

It is currently desirable to increase the operational speed of circular knitting machines and this results in the knitting needles being subjected to greater impact forces. When the operating speed of the circular knitting machine is increased, the speed of movement in a vertical direction increases as the needles are raised and lowered in the knitting operation. This increased vertical speed also increases the inertia that is generated at the upper and lower ends of the vertical movements of the needle so that high impact forces or shock are transmitted from the cams to the needle butts and to the needle hooks through the needle shank, thereby leading to an increased incidence of hook and/or butt breakage and wear. In certain cases, this increased inertia will cause the needle butts to deviate from the cam track and cause additional damage to the needles. It has been proposed that the weight of the needle be reduced to decrease the impact force and shock transmitted from the butts to the hooks; for example, U.S. Pat. Nos. 3,464,237 and 4,452,053 disclose stamped latch needles with cutouts spaced along the back edge of the needle to provide shock absorbing bridges positioned between the butt and hook. It is also known to provide cutouts in the form of slots, extending through the shank and/or butt of the needle to provide an anti-shock construction. Japanese Patent No. 1023328 (Publication No. SHO 55-9103) discloses a stamped needle in which a portion of the shank between the butt and the hook is provided with a circular configuration having substantially the same diameter as the width of the shank and with a central hole extending through the shank. This circular section of the shank reduces the weight of the needle and tends to reduce the transmittal of the impact forces from the butt to the hook.

While the various cutouts provided in the shank of needles have permitted increased operational speed of the circular knitting machines, these cutouts tend to limit the strength of the needle shank and must be limited to certain critical dimensions or the shank is weakened to the point that breakage of the shank may occur at high operating speeds.

SUMMARY OF THE INVENTION

With the foregoing in mind, it is an object of the present invention to reduce the weight of a knitting needle and to thereby improve the shock absorbing characteristics of the shank of the needle by providing a novel cross-sectional configuration to the shank of the knitting needle which does not have the dimensional limitations of the conventional cutouts and slots suggested by the prior art.

It is another object of the present invention to provide a manufacturing method to produce needles in accordance with the present invention wherein the cross-sectional configuration of the needle shank can be modified in an economical manner to reduce the transmittal of impact forces and to improve the shock absorbing characteristics of the needle.

In accordance with the present invention, the cross-sectional configuration of the shank of the needle is modified so that the central section of the shank of the needle is of a predetermined cross-sectional thickness which is less than the predetermined cross-sectional thickness of the outer and inner edge portions to define at least one elongate groove extending longitudinally along one side of the elongate shank of the needle. The elongate groove extends substantially throughout the length of the shank and parallel with the back of the needle. Elongate grooves in accordance with the present invention can be formed along the shank portion of needles which have substantially straight front and back edges. The elongate grooves can also be formed in needles provided with cutouts in the front and/or the rear edges of the shank to further reduce the weight of the needle and to enhance the shock absorbing characteristics thereof.

The ratio of the width of the center section, defining the elongate groove, to the width of the shank is preferably about 0.5 to 0.3 while the ratio of the thickness of the center section to the thickness of the adjacent outer and inner edge portions of the shank is about 0.8 to 0.6. Needles in accordance with the present invention can be manufactured by an alternate manufacturing method in a very economical and precise manner by initially forming one or more elongate grooves in coiled strip sheet metal material by either roller pressing the groove in the elongate strip material or grinding or milling away the material longitudinally to form the grooves. The needle blanks are then successively stamped from the coiled strip material so that the back edge of the needle is formed by the edge of the coiled strip material.

The elongate groove or grooves extending substantially parallel with and spaced from the back edge of the elongate shank also forms one or more passageways extending longitudinally along the needle shank to provide for improved retention and distribution of lubricant along the needle shank. The groove or grooves in the needle tend to cause the lubricant to be distributed longitudinally along the needle guide slots in the needle cylinder and aid in preventing the lubricant from being thrown out of the needle slots by centrifugal force, which is also increased with increased operational speeds of the needle cylinder.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENTS

Figure 1:
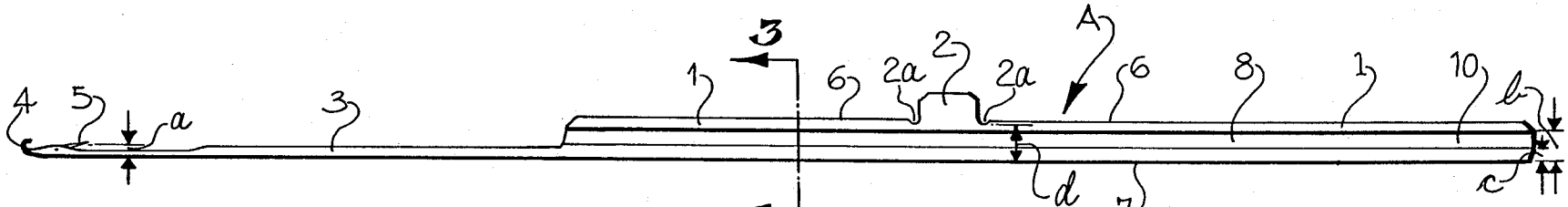
FIG. 1 is a side elevational view of a first embodiment of a knitting needle in accordance with the present invention.
Figure 2:
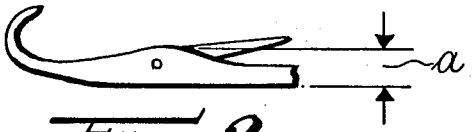
FIG. 2 is an enlarged view of the hook end of the needle of FIG. 1 to illustrate the width of the cheek.
Figure 3:
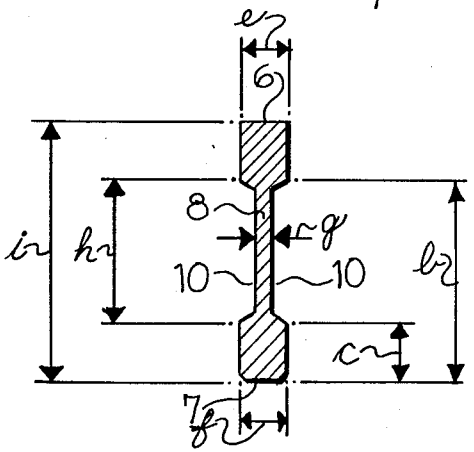
FIG. 3 is an enlarged vertical sectional view taken substantially along the line 3—3 in FIG. 1.

One embodiment of the knitting needle of the present invention, broadly indicated at A, is illustrated in FIGS. 1, 2 and 3. The needle A is provided with an elongate shank 1 including a butt 2 integral with and extending outwardly from an outer or front edge 6 of the shank 1. While only one butt is illustrated in FIG. 1, it is to be understood that the needle shank 1 may be provided with butts 2 at various positions spaced along the front edge 6 of the needle shank 1. These butts 2 extend outwardly beyond the needle cylinder grooves in which the needle is supported for longitudinal sliding movement, in the usual manner. A hook 4 and a pivoted latch 5 are provided on the upper end of a relatively narrow shank portion 3 for receiving yarn and forming stitch loops in the usual manner.

As best illustrated in FIG. 3, the cross-sectional configuration of the needle shank 1 has been modified in accordance with the present invention to provide a thin central section 8 extending longitudinally of the shank 1 and between the outer or front edge 6 and a back or inner edge 7. The central section 8 is of a predetermined cross-sectional thickness which is less than the predetermined cross-sectional thickness of the outer and inner edge portions extending inwardly from the corresponding front edge 6 and back edge 7. In the embodiment illustrated in FIGS. 1–3, the thinner central section 8 defines an elongate groove 10 extending longitudinally along opposite sides of the needle shank 1. The grooves 10 extend substantially parallel with and are spaced from the back edge 7 of the elongate shank 1. While a single groove 10 is illustrated on each side of the shank 1, it is to be understood that a groove 10 could be provided on only one side of the shank 1, or one or both sides of the shank 1 could be provided with a plural number of grooves having a lesser width than that illustrated with FIG. 3 for the single grooves 10.

The distance c (FIG. 3) between the lower edge of groove 10 and the back edge 7 of the shank 1 is preferably greater than the height a (FIG. 2) of the cheek of the hook 4. The distance b between the upper edge of the groove 10 and the back edge 7 of the needle shank is less than the distance d (FIG. 1) between the bottom of cutouts 2*a* at both sides of butt 2 and the rear edge 7 of the needle shank 1.

It is preferred that the ratio of the width h of groove 10 to the width i of the needle shank 1 be from about 0.5 to 0.3. It is also preferred that the ratio of the thickness g of the central section 8 to the thickness e and f of the outer and inner edge portions adjacent the corresponding front and rear edges 6 and 7 be from about 0.8 to 0.6. It has been found that when the thickness ratio of the central section 8 is larger than 0.8, sufficient shock absorbing characteristics are not provided in the needle. When the thickness ratio of the central section 8 is smaller than 0.6, the strength of the needle shank 1 is decreased to the point that there is a likelihood of breakage of the needle shank.

Figure 4:
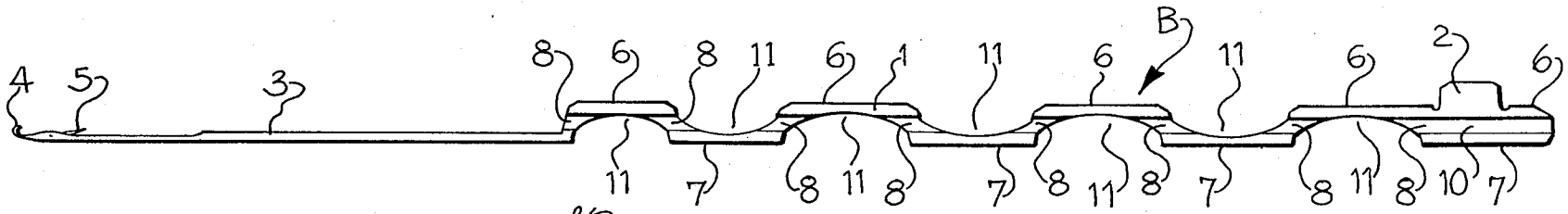
FIG. 4 is a side elevational view of a second embodiment of knitting needle in accordance with the present invention.

The embodiment of the needle B shown in FIG. 4 is similar to the embodiment shown in FIGS. 1–3 and the same reference characters are applied to corresponding parts. However, this embodiment B of the knitting needle is provided with spaced cutouts 11 spaced along the needle shank 1 and extending inwardly in an alternate arrangement from the front and rear edges 6, 7 to provide "bridges" which reduce the weight of the knitting needle and also give some sectional resiliency to the needle. It is preferred that the depth of the cutouts 11 be limited to the bottom of the groove 10 when the cutout 11 is provided from the front edge 6 of the shank 1. The depth of the cutout 11 is preferably limited to the top of the groove 10 when the cutout 11 is provided from the back edge of the needle shank.

Method of Manufacture

In the conventional method of manufacturing stamped knitting needles it is the common practice to roll the sheet material to the desired thickness, slit the material into elongate strips to the desired width for stamping individual needles therefrom, and then round shave the sides of the slit material to provide round edges prior to stamping the individual needles from the coiled strip material. This conventional method of manufacturing knitting needles can be followed to produce needles in accordance with the present invention and then the grooves 10 can be formed in the individual knitting needles after the stamping operation. However, forming grooves 10 in the individual needles requires complicated machining steps and would result in a relatively high cost of manufacturing needles with elongate grooves therein.

Figure 5:
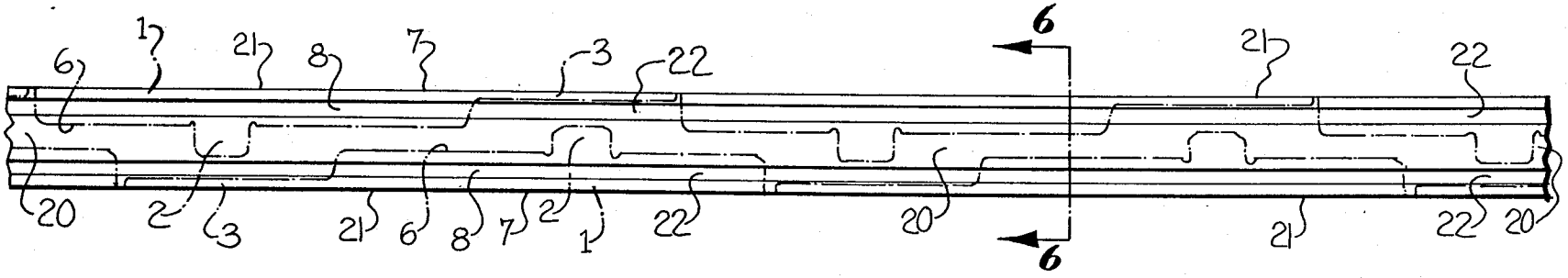
FIG. 5 is a side elevational view of an elongate strip of sheet metal and illustrating the manner in which elongate grooves can be formed on both sides of the strip metal prior to stamping knitting needles in staggered relationship along opposite edge portions of the strip material.
Figure 6:
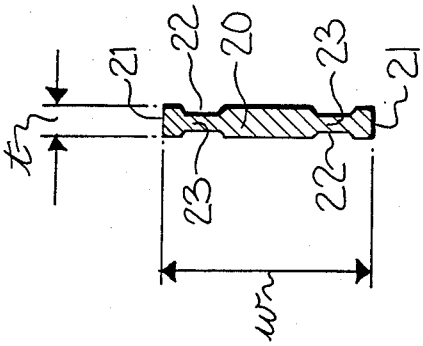
FIG. 6 is an enlarged vertical sectional view taken substantially along the line 6—6 in FIG. 5 and illustrating the manner in which elongate grooves are formed in opposite sides thereof.

The preferred method of manufacturing knitting needles in accordance with the present invention is illustrated in FIGS. 5 and 6. In accordance with this preferred method, a continous coil of strip material, indicated at 20, can be formed in accordance with the conventional process of rolling, slitting and shaving in a continuous manner and continuous grooves, indicated at 22, may be provided on one or both sides of the coiled material 20 simultaneously with, or before or after the various processes before the needle stamping process. In other words, the grooves 22 may be formed during the process of rolling the coiled material 20 to the desired thickness, as indicated at t in FIG. 6, the process of slitting the material to the desired width, as indicated at w in FIG. 6, or the process to shave or round the opposite edges 21 of the strip material. The grooves 22 may be formed in one or both sides of the strip material 20 during either of the above-mentioned processes by either rolling, shaving, milling or otherwise forming the grooves therein. Since it is desirable to use a strip material 20 having a width w which is wide enough to provide two needle blanks with their respective back edges 7 co-extensive with the opposite sides 21 of the strip 20, as indicated in FIG. 5, thinner central sections 23 are formed by the respective grooves 22 extending parallel to and spaced from the opposite sides 21 of the strip material 20.

After the grooves 22 are formed, by rolling, machining or the like, the strip material 20 is subjected to a stamping operation in which needle blanks are stamped therefrom in the manner indicated in FIG. 5 so that the thin center section 23 of the strip material is utilized as the center section 8 of each knitting needle blank and the edges of the coil material become the rear edges 7 of the knitting needle blanks. By stamping the knitting needle blanks in the manner indicated in FIG. 5, knitting needle blanks are stamped from both the top and the bottom part of the strip material 20.

Knitting needles in accordance with the present invention are provided with a thin central section 8 which is defined by one or more elongate grooves 10 extending longitudinally along at least one side of the elongate shank 1 of the needle. These elongate grooves 10 reduce the overall weight of the needle without unduly impairing the vertical rigidity of the needle shank. This reduction of needle weight or mass permits an accompanying increase of speed of the circular knitting machine without increasing the impact forces and inertia that normally occur when needle speed is increased without varying the cross-sectional configuration of the knitting needles. The knitting needle in accordance with this invention can, therefore, be used for a long period of time with stability and can comply with high speed operation of the circular knitting machine.

In the case of needles in accordance with the present invention having cutouts 11, as illustrated in FIG. 3, the cutouts 11 reduce the weight of the needle and provide some reduction of the vertical rigidity of the needle to give some resiliency between the butt 2 and the hook 4 to absorb the shock of the impact force applied to the butt and thus reduce butt wear and hook breakage. By applying the elongate grooves 10 to this type of needle, butt wear and hook breakage can be further reduced and circular knitting machine speed can be increased. The elongate grooves 10 provided in the needle in accordance with the present invention do not change the width of the shank 1 of the needle so that the vertical and horizontal stability of the needle is maintained as it is moved up and down in the guide slots of the needle cylinder in the formation of stitch loops. Thus, fabric of good quality can be produced with knitting needles having improved cross-sectional configurations and without requiring special shapes and cross-sectional configurations of the conventional needle slots in the needle cylinder.

In accordance with the preferred method of the present invention, the elongate grooves 10 can be economically formed simultaneously with or in conjunction with the usual continuous rolling, slitting and/or round shaving operations and prior to the stamping of the needle blanks from the strip material. The elongate grooves 10 also form one or more passageways extending longitudinally along the needle shank 1 to provide for improved retention and distribution of lubricant along the needle shank.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which is claimed is:

1. In a knitting needle comprising an elongate shank including opposite sides, outer and inner edge portions of the same cross-sectional thickness and extending along corresponding front and back edges of said elongate shank, a hook on one end of said shank, and butt means integral with and extending outwardly from said front edge, the combination therewith of a central section extending longitudinally of said shank and between said outer and inner edge portions, said central section being of a predetermined cross-sectional thickness which is less than the cross-sectional thickness of said outer and inner edge portions and defining at least one elongate groove extending longitudinally along at least one of said opposite sides of said elongate shank and said elongate groove extending substantially parallel with and spaced from said back edge of said elongate shank, said groove providing improved shock absorbing characteristics to the needle to reduce the transmission of shock from said needle butt means to said hook, said groove also providing a passageway extending longitudinally along said needle shank to provide for improved retention and distribution of lubricant along said needle shank.

2. A knitting needle according to claim 1 wherein an elongate groove is provided along each of said opposite sides of said elongate shank.

3. A knitting needle according to claim 1 including cutouts spaced along at least said front or back edges of said elongate shank.

4. A knitting needle according to claim 3 wherein said cutouts are provided along both said front and back edges of said elongate shank and alternately extend inwardly therefrom and into said elongate groove.

5. A knitting needle according to claim 1 wherein the ratio of the cross-sectional width of said central section to said cross-sectional width between said front and back edges of said shank is 0.5 to 0.3.

6. A knitting needle according to claim 1 wherein the ratio of the cross-sectional thickness of said central section to the cross-sectional thickness of said outer and inner edge portions of said shank is 0.8 to 0.6.

7. A knitting needle according to claim 1 wherein the ratio of the cross-sectional width of said central section to said cross-sectional width between said front and back edges of said shank is 0.5 to 0.3, and wherein the ratio of the cross-sectional thickness of said central section to the cross-sectional thickness of said outer and inner edge portions of said shank is 0.8 to 0.6.

* * * * *